US005332364A

United States Patent [19]

Rodarmer

[11] Patent Number: 5,332,364

[45] Date of Patent: Jul. 26, 1994

[54] ROTATABLE CEILING FAN ACCESSORY

[76] Inventor: Larry Rodarmer, 278 Overstreet Ct., Palm Harbor, Fla. 34683

[21] Appl. No.: 8,123

[22] Filed: Jan. 25, 1993

[51] Int. Cl.[5] ..... F04N 29/00

[52] U.S. Cl. ..... 416/146 R; 416/61; 446/178; 446/217; 446/201

[58] Field of Search ..... 416/5, 61, 146 R; 446/176, 178, 201, 217, 218; D23/377, 379, 385

[56] References Cited

U.S. PATENT DOCUMENTS

| | | | |
|---|---|---|---|
| 913,994 | 3/1909 | Turner | 416/5 |
| 1,496,263 | 6/1924 | Friedman | 416/146 |
| 1,542,731 | 6/1925 | Schortmann | 446/217 |
| 1,596,806 | 8/1926 | Ciller | 446/178 |
| 1,764,180 | 6/1930 | Moreland | 446/217 |
| 2,581,185 | 1/1952 | Gordon . | |
| 2,711,165 | 6/1955 | Leavenworth . | |
| 4,666,670 | 5/1987 | Cox . | |
| 4,863,346 | 9/1989 | Lin . | |
| 5,094,676 | 3/1992 | Karbacher | 416/146 R |

FOREIGN PATENT DOCUMENTS

| | | | |
|---|---|---|---|
| 301994 | 12/1989 | Japan | 416/5 |
| 301995 | 12/1989 | Japan | 416/5 |

*Primary Examiner*—Edward K. Look
*Assistant Examiner*—James A. Larson
*Attorney, Agent, or Firm*—Henderson & Sturm

[57] ABSTRACT

An accessory (10) mounted for relative rotation with respect to a conventional ceiling fan (100); wherein, the accessory (10) includes a housing unit (13) suspended from the ceiling fan (100) and bearing visual elements (60) whose appearance will change relative to a stationary viewer, in response to the rotation of the housing unit (13) due to air currents generated by the ceiling fan (100) impinging upon a propulsion unit (14) contained within the housing unit.

2 Claims, 1 Drawing Sheet

ROTATABLE CEILING FAN ACCESSORY

TECHNICAL FIELD

The present invention relates to the field of fan constructions in general, and in particular to an independently rotatable accessory for a ceiling fan.

BACKGROUND ART

As can be seen by reference to the following U.S. Pat. Nos. 2,581,185; 4,863,346; 2,711,165; and 4,666,670; the prior art is replete with myriad and diverse accessories and housings for fans in general and ceiling fans in particular, such as lights, scent holders, and sound markers.

While all of the aforementioned prior art constructions are more than adequate for the basic purpose and function for which they have been specifically designed, these patented devices are neither suited for, nor adapted to serve the particular purpose and function provided by the subject matter of the present invention.

While mobile sculptures are well recognized as a source of visual entertainment for both adults and children, to date no one has combined a moveable accessory that can be attached directly to, and driven by the air currents generated by the blades of a ceiling fan.

As a consequence of the foregoing situation, there has existed a longstanding need for a ruggedly constructed moveable accessory for a ceiling fan that will produce an aesthetically pleasing, changeable, yet sequential visual appearance for a ceiling fan which is both directly and indirectly moveable in response to the actuation of the ceiling fan; and, the provision of such a construction is a stated objective of the present invention.

DISCLOSURE OF THE INVENTION

Briefly stated, the moveable accessory for ceiling fans that forms the basis of the present invention comprises in general: an axle unit, a hub unit; a rotatable housing unit; and, a propulsion unit.

The axle unit is suspended from the bottom portion of the ceiling fan accessory and operatively attached to the hub unit. In addition, the hub unit is rotatably connected to the axle unit and secured to the housing unit; wherein, the housing unit contains the propulsion unit that reacts to the air currents generated by the blades of the ceiling fan.

As will be explained in greater detail further on in the specification, the outer surface of the housing unit is provided with one or more decorative items such as a variable pattern, a plurality of spaced figures, etc. whose relative appearance with respect to a stationary viewer will change in response to the rotating movement of the housing unit relative to the axle unit.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
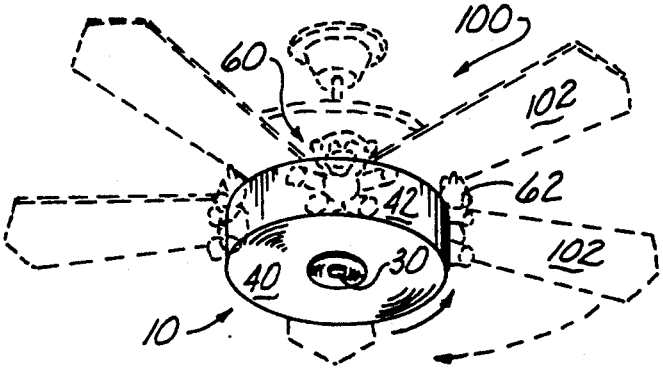
FIG. 1 is a perspective view of the accessory mounted on a conventional ceiling fan.
Figure 3:
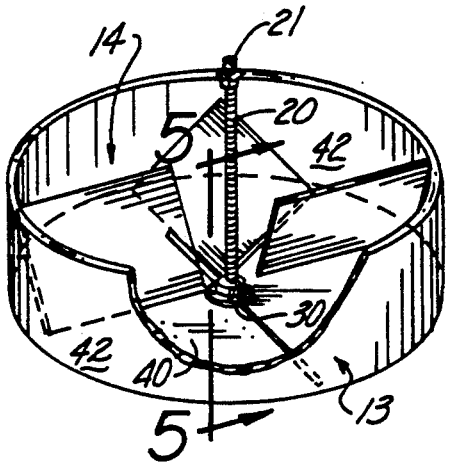
FIG. 3 is an isolated perspective view of the accessory.

As can be seen by reference to the drawings, and in particular to FIGS. 1 and 3 the rotatable accessory for ceiling fans that forms the basis of the present invention is designated generally by the reference numeral (10). The accessory comprises in general: an axle unit (11); a hub unit (12); a housing unit (13); and a propulsion unit (14). These units will now be described in seriatim fashion.

Figure 2:
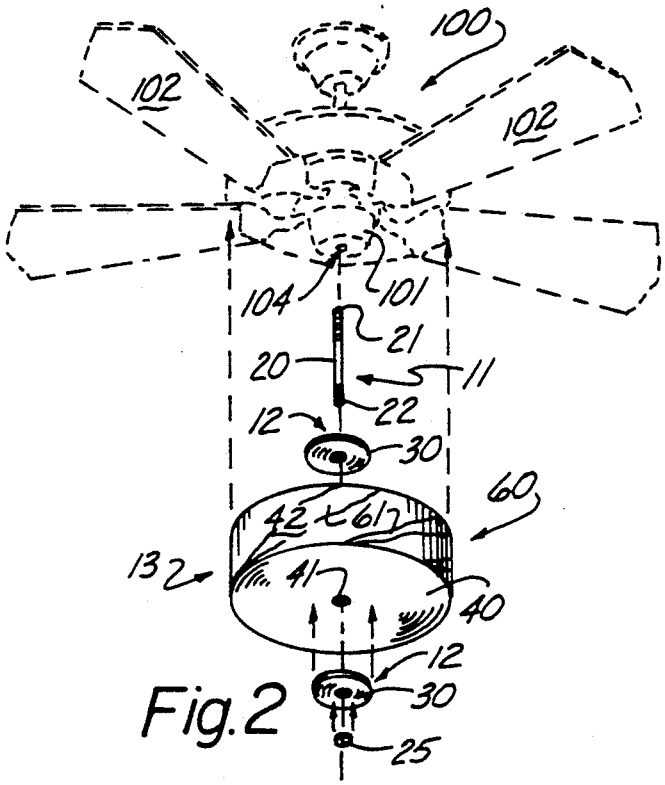
FIG. 2 is an exploded perspective view of the accessory and ceiling fan.

As shown in FIGS. 1 and 2, the accessory (10) is designed to be connected to the stationary hub housing (101) of a conventional ceiling fan (100) such that the rotatable movement of the accessory (10) will occur independently of the rotation of the blades (102) of the ceiling fan (100)

Figure 5:
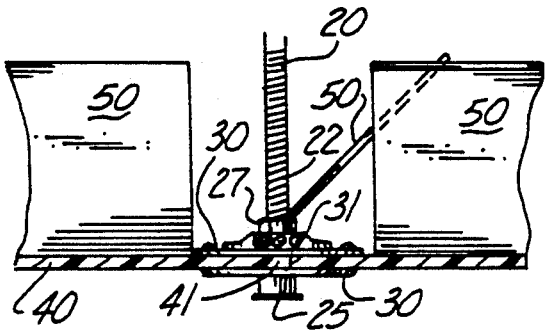
FIG. 5 is an isolated detail view of the internal structure of the accessory.

Turning now to FIGS. 2, 3 and 5 it can be seen that the axle unit (11) comprises an elongated threaded axle rod member (20) having an upper end (21) that is adapted to engage a suitably threaded opening (104) in the hub housing (101) of the ceiling fan (100); and, having a lower end (22) dimensioned to engage a threaded cap element (25) for reasons that will be explained presently.

As can best be seen by reference to FIGS. 2, 3 and 5, the hub unit (12) comprises a pair of generally flat circular hub members (30) having a central opening dimensioned to receive the threaded axle rod member (20); wherein at least one of the hub disk members (30) is provided with a roller bearing element (31) which will permit the rotation of the hub unit (12) relative to the axle unit (11).

In addition the axle member (20) is further provided with a threaded nut (27) for moving the hub disk members (30) towards one another for reasons that will be explained presently.

Figure 4:
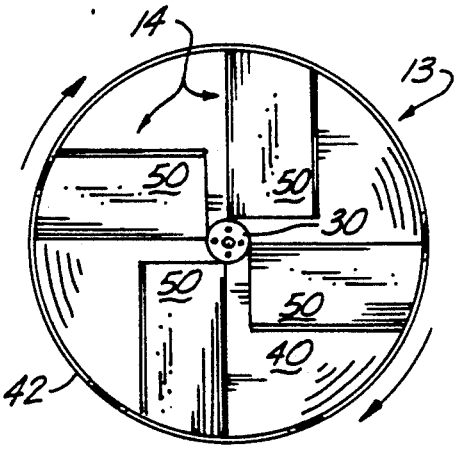
FIG. 4 is a top plan view of the accessory.

Referring now to FIGS. 3 through 5, it can be seen that the housing unit (13) comprises a generally circular base member (40) having a central aperture (41); wherein, the periphery of the base member (40) is surrounded by a generally cylindrical raised sidewall (42). In addition, the propulsion member (14) comprises a plurality of angled vane members (50) arrayed in a radial fashion around the interior of the housing unit (13).

As can be seen in particular by reference to FIG. 5, the axle rod member (20) is dimensioned to be received by the central aperture (41) in the base member (40) wherein the hub members (30) are adapted to be brought into captive engagement with opposite sides of the base member (40) by the combined cooperation between the threaded nut (27) and the cap element (25).

At this juncture the upper end (21) of the axle rod member (20) is operatively attached to the bottom of the hub (101) of the ceiling fan (100), to suspend the accessory (10) in a freely rotatable manner relative to the ceiling fan (100).

Now when the ceiling fan (100) is turned on, the air current generated by the rotating blades (102) of the ceiling fan (100) will impinge upon the angled vanes (50) within the housing unit (13) to cause the housing unit (13) to rotate in either a clockwise or counterclockwise direction relative to the ceiling fan (100) depending upon the angular orientation of the vanes (50).

In addition as was previously mentioned in the specification and depicted in FIGS. 1 and 2 the sidewalls (42)

of the housing unit (13) are provided with visual elements (60) such as a printed pattern (61) and/or three dimensional objects (62) such as small stuffed animals whose visual appearance relative to a stationary viewer will change as the housing unit (13) rotates in response to the air currents generated by the ceiling fan (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An accessory for ceiling fans having a plurality of fan blades rotating around a stationary ceiling fan hub housing which is suspended from a ceiling wherein the accessory comprises:

a housing unit including a base member surrounded by raised sidewalls, wherein the exterior surface of the raised sidewalls are provided with visual elements; and, means for rotatably suspending said housing unit from the ceiling fan hub housing; means for rotating said housing unit both independently of, and in cooperation with, the rotation of said fan blades; such that the visual elements will present a changeable appearance to a stationary viewer; wherein, said means for rotatably suspending said housing unit from the ceiling fan hub housing comprises:

a hub unit operatively associated with said housing unit; and, an axle rod member having one end operatively connected to, and disposed in a relatively rotatable relationship with, said hub unit; and, having another end that is secured in a stationary fashion relative to said ceiling fan hub housing.

2. The accessory as in claim 1 wherein, said means for rotating said housing unit comprises:

a plurality of angled vanes radially arrayed on the interior of said housing unit.

* * * * *